US005137156A

United States Patent [19]

Riczinger et al.

[11] Patent Number: 5,137,156

[45] Date of Patent: Aug. 11, 1992

[54] HOSE AND TOOL RACK

[75] Inventors: Richard F. Riczinger, Maple Heights; Darwin T. McKnight, Louisville, both of Ohio

[73] Assignee: The Hoover Company, North Canton, Ohio

[21] Appl. No.: 638,448

[22] Filed: Jan. 4, 1991

[51] Int. Cl.[5] ..... A47F 7/00

[52] U.S. Cl. ..... 211/13; 211/70.6; 248/52

[58] Field of Search ..... 211/13, 86, 70.6; 248/52

[56] References Cited

U.S. PATENT DOCUMENTS

| | | | |
|---|---|---|---|
| 1,970,576 | 8/1934 | Replogle et al. | 211/13 X |
| 2,248,585 | 7/1941 | Ross et al. | 211/13 X |
| 2,268,364 | 12/1941 | White et al. | 211/13 |
| 2,386,489 | 10/1945 | McKellar | 211/13 X |
| 2,450,172 | 9/1948 | Stoner . | |
| 2,506,897 | 5/1950 | Sheker | 211/13 X |
| 2,549,349 | 4/1951 | Wahlstrom . | |
| 2,591,365 | 4/1952 | Liesener | 211/13 |
| 2,603,816 | 7/1952 | MacFarland | 211/13 X |
| 2,819,485 | 1/1958 | Sparklin . | |
| 3,888,643 | 6/1975 | Yoshikawa et al. . | |
| 3,955,237 | 5/1976 | Chateauneuf et al. . | |
| 4,541,142 | 9/1985 | Pudwill . | |

FOREIGN PATENT DOCUMENTS

| | | |
|---|---|---|
| 6713604 | 4/1968 | Netherlands . |
| 347950 | 7/1960 | Switzerland . |
| 354117 | 8/1931 | United Kingdom . |
| 637918 | 5/1950 | United Kingdom . |
| 1005697 | 9/1965 | United Kingdom . |

OTHER PUBLICATIONS

Catalog Sheet Legacy ® cleaner.
Catalog Sheet Turbomaster TM cleaner.

*Primary Examiner*—Robert W. Gibson, Jr.

[57] ABSTRACT

A tool and hose rack is shown including a positive serpentine mounting for the hose which is discontinuous and offset to provide for overlap of the coiled hose. The hose mounting is U-shaped in cross section and includes ribbing to positively locate the mounted hose longitudinally.

13 Claims, 5 Drawing Sheets

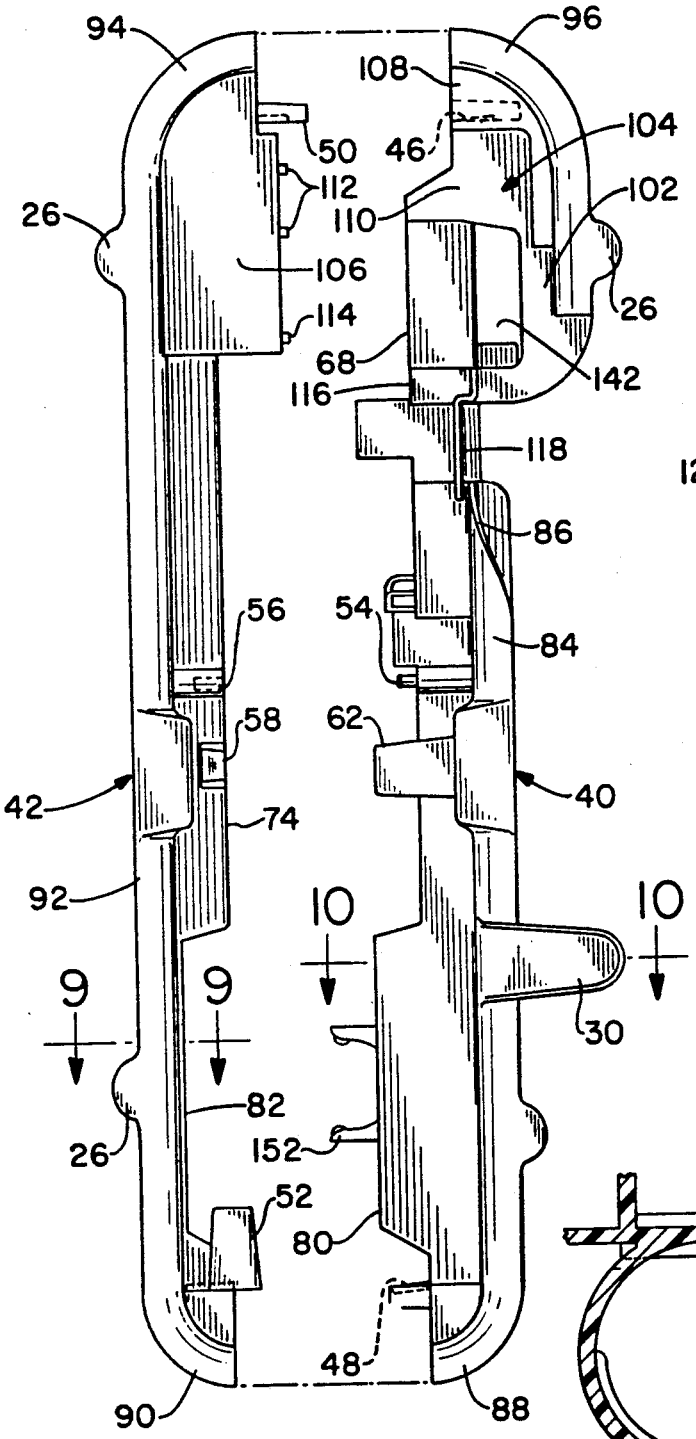
FIG.-3
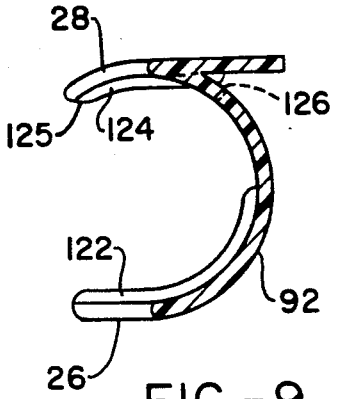
FIG.-9
FIG.-10
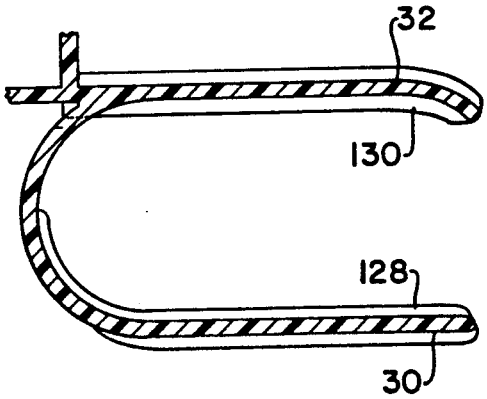

HOSE AND TOOL RACK

BACKGROUND OF THE INVENTION

1. Field of the Invention

This invention relates to floor care appliances and, more specifically to a hose and tool rack which may be mounted for use with an upright cleaner.

Although hose and tool rack arrangements mounted with an upright cleaner are well known, the closest perhaps being the tool and hose rack sold as a part of the domestically available Legacy® cleaner by the instant assignee, no known tool and hose rack includes provision for an extended length hose which, because of its length, must in some manner be stored in a compact mass on the cleaner. Also, no tool and hose rack presently teaches the mounting of the cleaner connecting end of the hose in an unconnected state in the center of the coiled hose mass. Since this both encourages easy, full uncoiling of the hose prior to actual use and also protects what is, normally, the least durable of the hose end fittings this is advantageous. Further no known hose rack mounting clips for hose storage act not only by clamping the diameter of the hose but also by positively preventing axial movement of the hose on the rack.

Accordingly, it is an object of the invention to provide a tool and hose rack having provision for overlapped storage of a suction hose.

It is an additional object of the invention to provide a spiralled, overlapped suction hose storage configuration.

It is a further object of the invention to provide a hose rack storage means having a discontinuity to permit positive inner and outer overlapped storage of the hose on the storage means.

It is an even further object of the invention to provide guided mount for a spiralled suction hose in its stored condition.

It is a still further object of the invention to storingly place the unconnected cleaner suction hose connecting end at the inner end of the stored mass of suction hose.

It is a further object of the invention to spiral the suction hose in stored condition with the cleaner suction connection end at the inner portion of the spiral.

It is an additional object of the invention to provide a hose storage arrangement with a hose mounting clip having positive means for limiting axial movement of the hose.

It is an additional object of the invention to provide a hose storage clip having a transversely extending rib insertable in a corrugation of a suction hose.

It is a final object of the invention to provide an improved tool and hose rack usable for the storage of demountable cleaning tools and/or a demountable suction hose connectible to a floor care appliance or the like.

SUMMARY OF THE INVENTION

The invention comprehends the provision of a two piece easily moldable tool and hose rack held together by one way locking barbs in one of the pieces engaging in the other. When engaged these two pieces form a generally double horseshoe shaped spiraling hose rack providing a transversely extending U-shaped nesting trough for hose mounting and stable maintenance of it. The inner end of the spiral rack shape of the mounting is generally centrally disposed vertically and extends downwardly to turn clockwise upwardly from its downward extent to pass horizontally spacedly past the inner end of the spiral shape and then above it to an upper clockwise bend. The spiral shape is completed by another vertically extension of it which is more horizontally spaced from and widely located than the downward extent of the inner vertical end of the spiral to thereby provide for axially, aligned, spiral mounting of the coiled suction hose. This vertical extension terminates short of the upper, inner end of the spiral mount to provide clearance for insertion of the inner end of the suction hose before it is coiled around the mount.

The cleaner suction end of the hose includes an attached suction coupling of smaller outside dimensions than the wand (other end) coupling so that the area of the tool and hose at the inner end of the spiral mount is provided with a well that is dimensioned large enough to accommodate only the suction coupling end. No real well is provided by the tool and hose rack for the wand coupling since the depending mounted hose and its engagement in the ribbed clips provides for a secure retention of this coupling in an upright fashion relative to the remainder of the tool and hose rack.

Hose retaining clips are formed by spaced tabs which extend outwardly from the U-shaped trough to clampingly hold the hose at spaced locations. Two pairs of oppositely disposed, slightly inwardly bent, equally sized tabs are provided on each side of the U-trough spiral mounting arrangement. An additional elongated outwardly jutting oppositely disposed tab pair is also located where the suction hose overlaps so that these tabs may clampingly retain both coils of the suction hose.

All of the tabs includes a mediately disposed rib that extends into the U-shaped trough, with these ribs extending transversely relative to the linear extent of the U-shaped trough and outward extension of the clips so as to be engageable in a corrugation of the suction hose. The hose may have these ribs inserted in their adjacent corrugations, with the hose either in a slightly elongated or a normal configuration, to maintain the hose securely laterally while, at the same time, being clamped on their circumferences by the confronting tabs.

The tool and hose rack may be mounted, for example, to an upright cleaner handle or the like (not shown) conveniently through a series of provided bent over mounting tabs and a screw tab, all of these tabs being integral with the tool rack. It is to be understood that the unit could be provided free standing also or that any other conventional tab or screw arrangement, obviously could be utilized for mounting purposes for the tool and hose rack.

The tool and hose rack also is afforded with integral structure for the conventional mounting of a furniture nozzle, crevice tool and wall and floor brush.

BRIEF DESCRIPTION OF THE DRAWINGS

Reference may now be had to the accompanying Drawings for a better understanding of the invention, both as to its organization and function, with the illustration being of a preferred embodiment, but being only exemplary, and in which:

FIG. 3 is an exploded right side elevational view of the tool and hose rack of FIG. 2 and showing its two mating parts;

FIG. 9 is a cross sectional view of an exemplary U-shaped trough and tab arrangement taken on line 9—9 of FIG. 3;

FIG. 10 is a cross sectional view of the U-shaped trough and elongated tab arrangement taken on line 10—10 of FIG. 3.

DETAILED DESCRIPTION OF DRAWING

Figure 1:
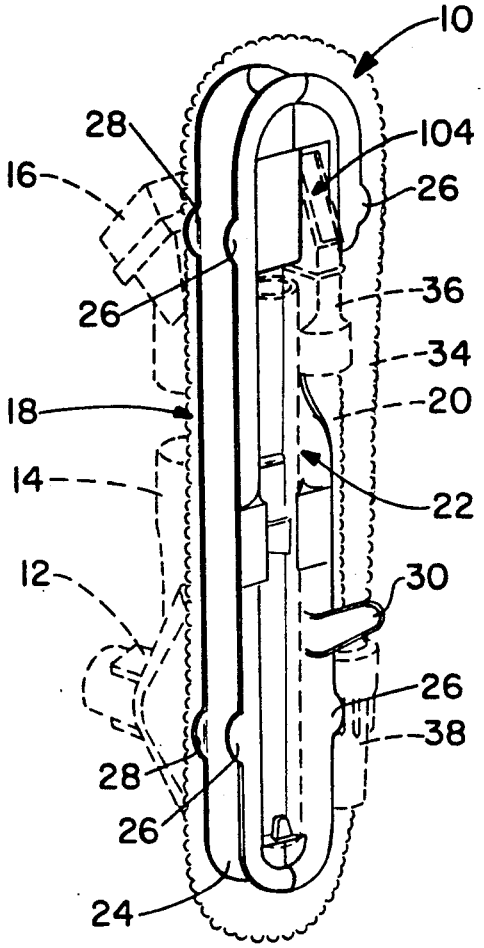
FIG. 1 is a right front perspective view of the inventive tool and hose rack showing the tools and hose mounted.
Figure 2:
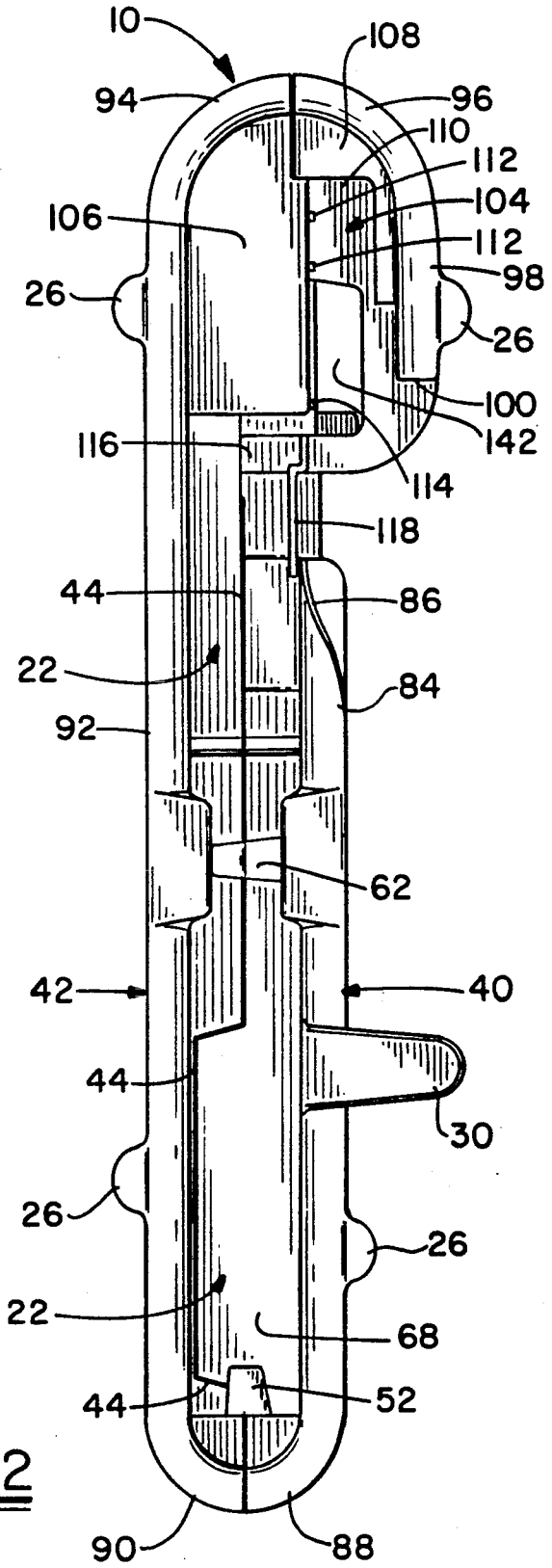
FIG. 2 is a right side elevational view of the tool and hose rack with the tools and hose removed.
Figure 4:
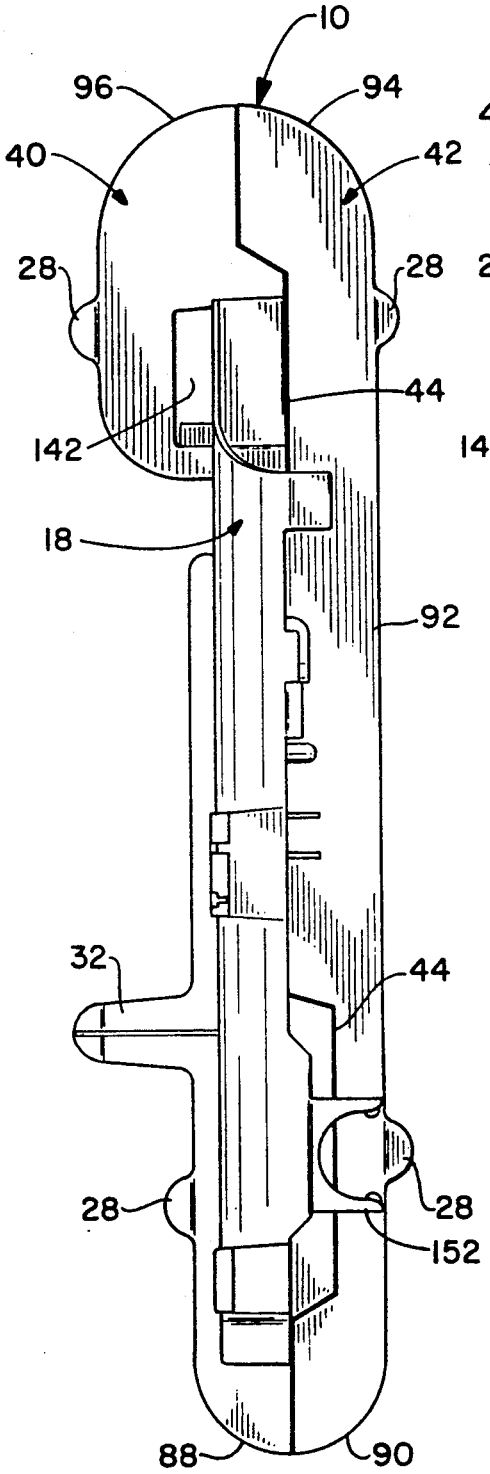
FIG. 4 is a left side elevational view of the tool and hose rack disposed like FIG. 2.
Figure 5:
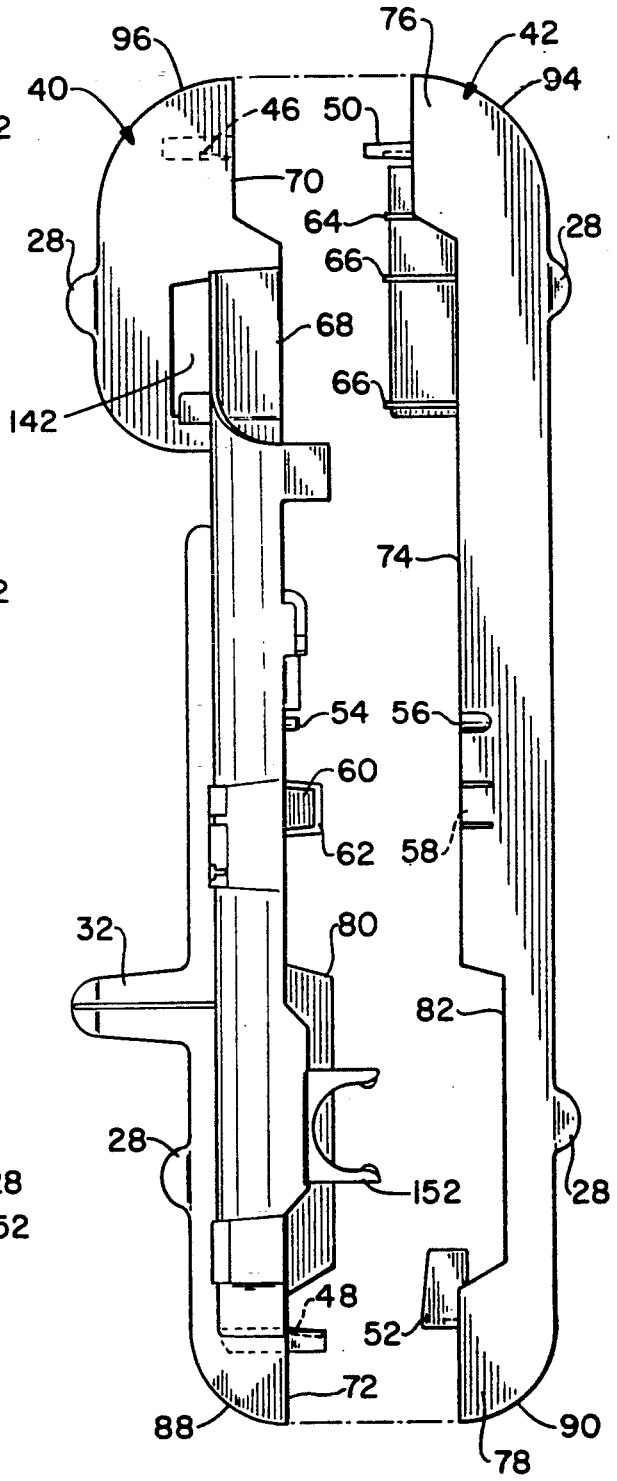
FIG. 5 is a left side exploded elevational view of the tool and hose rack of FIG. 4.
Figure 6:
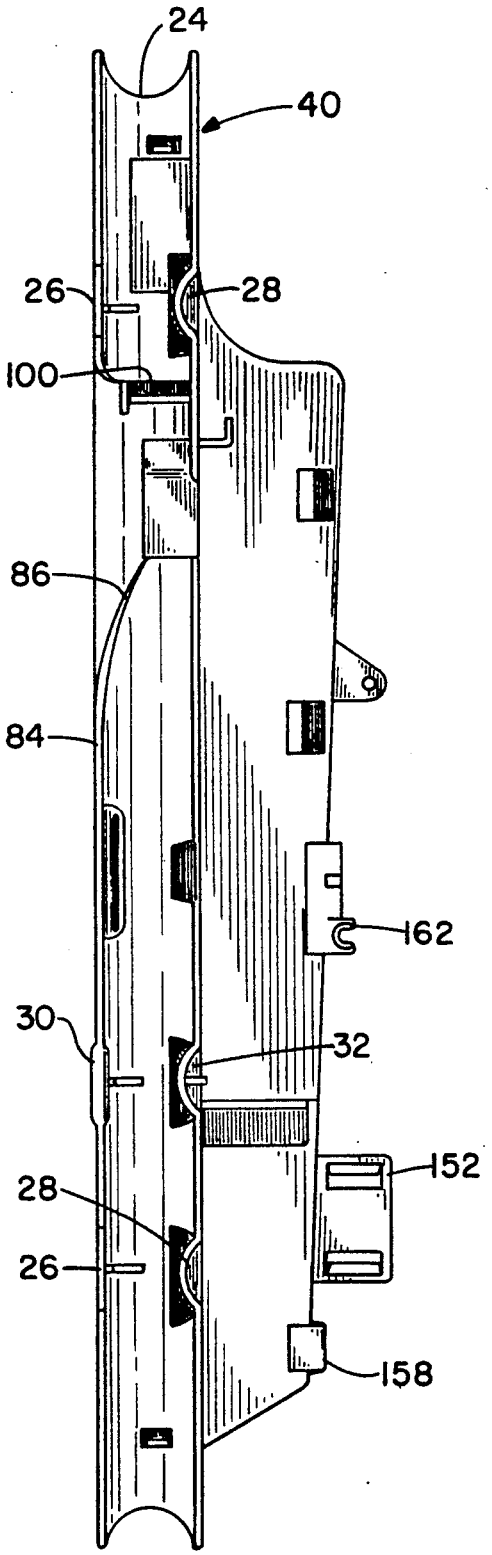
FIG. 6 is an elevational front view of the tool and hose rack of FIG. 2.
Figure 7:
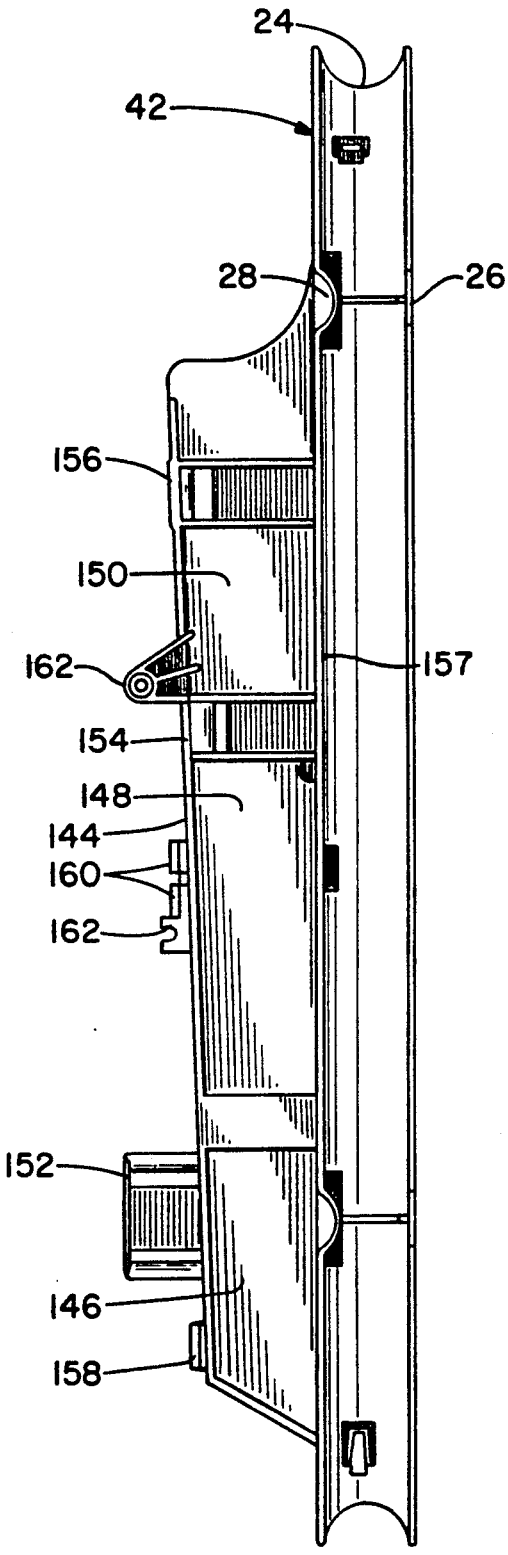
FIG. 7 is an elevational rear view of the tool and hose rack of FIG. 2.
Figure 8:
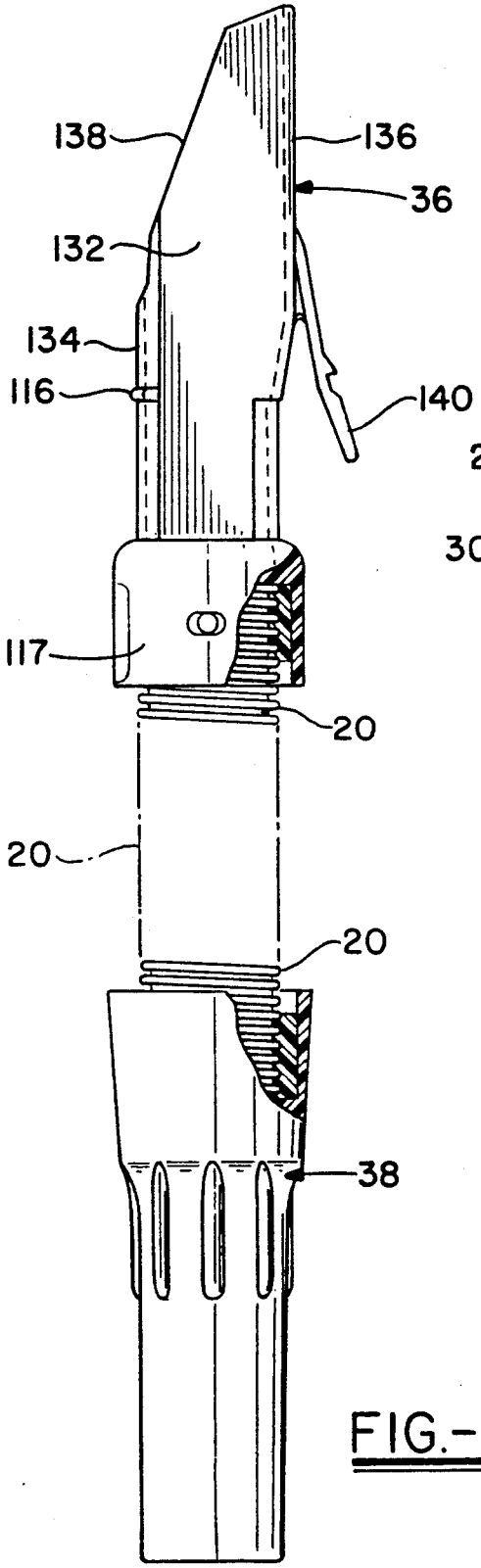
FIG. 8 is a frontal view of the unmounted hose and its end coupling.

There is shown in FIG. 1 a tool and hose rack 10 which conventionally mounts a furniture nozzle 12, a crevice tool 14 and a wall and floor brush 16 on a rear side 18 of it. A hose 20, specifically a blow molded hose, is also shown mounted on its front side 22 by being disposed in a double horseshoe trough 24 that forms an overlapping spiral shaped mounting for the hose 20. A series of opposed small tabs 26, 28, four sets in number, clamp the hose 20 into the double horseshoe trough 24, with the hose normally mounted generally vertically in a normal cleaner handle mounted (not shown) vertical disposition of the tool rack 10 as shown in FIG. 1. Large opposed tabs 30, 32 also clamp the hose 20 through the overlap 34 of the spiralling hose 20 to maintain the outer end of the hose in a secure manner.

Connector ends 36, 38 of hose 20, comprising cleaner suction converter end 36 and wand coupling end 38 are shown with the wand coupler end 38 of hose 20 outermost in the spiral of the hose 20 and the converter end 36 innermost. It is seen that the converter end 36 is disposed is a somewhat sheltered position inwardly in the tool and hose rack 10, behind the overlap 34 and removed from its lower end.

Turning now to FIG. 2–7, the tool rack 10 can be seen to be made up of two confronting mating parts 40, 42 and having an assembled parting line 44. These two tool and hose rack parts are maintained together, primarily, by a pair of upper and lower one way barbs 46, 48 integral with the part 40 which engage in, conventionally, apertures (not shown) in an upper tab 50 and lower stub piece 52. The tool and hose rack 10 is also maintained assembled by a medial disposed alignment pin 54, integral with part 40, that is telescopically received in a bored boss 56, integral with part 42 and a barbed latch 58 on part 42 engaging in depressed well 60 formed on a tab 62 on part 40, this tab and well being disposed below the alignment pin 54.

Also to aid with alignment, inwardly extending ribs 64 and 66, 66 are formed on an upper portion of the part 42. These ribs slide tightly behind an integral inner vertically extending web 68 of part 40 when the tool and hose rack is assembled as does lower stub piece 52.

Vertical web 68 of tool and hose rack part 40 includes upper and lower angular cutouts 70 and 72 at its terminating ends to provide offsets to parting line 44. Tool and hose rack part 42 also includes an inwardly and vertically extending web 74 that has upper and lower angular tips 76, 78 so that the webs 68 and 74 abut along their linear extent at the parting line 44 with the tips 76, 78 thereby extending into the cutouts to provide more strength to the assembled tool and hose rack 10. Immediately above lower cutout 72 and lower tip 78 are an angularly shaped intermediate inwardly extending projection 80 on vertical web 68 of part 40 and an angularly shaped intermediate cutout 82 on web 74 of part 42 to thereby also form a non linear portion of parting line 44. The projection 80 also provides an area for the location of a portion of the tool storing means (to be described later).

The double horseshoe trough 24 is formed in its spiralling manner by assembly of the parts 40 and 42. More specifically, part 40 includes an inner vertically extending trough part 84 generally U-shaped in cross section as is the remainder of the horseshoe trough 24. It has an angled relief 86 on the outer, transverse side of U-shaped trough 24, at the upper end of the vertically extending trough part 84 to provide clearance for hose end insertion. Below trough part 84 is an integral lower trough bend part 88 providing a 90° turn for double horseshoe trough 24. This trough bend part melds with an oppositely and equally radiused lower trough bend part 90 on part 2 so that a smooth 180° bend is provided as a part of the spiralling shape of hose 20.

Immediately above this bend part is an elongated vertically extending outer trough part 92 that extends substantially vertically above the upper termination of inner trough part 84. It is integrally joined, at its upper end, to an upper trough bend part 94, this bend part again providing a 90° turn but of a larger radius than the trough bend parts 88, 90. Part 40 also includes an upper trough bend part 96, formed with a curve having the same radius as trough bend part 94 that molds with trough bend part 94 to form another continuous 180° bend to permit forming a second loop in the stored hose 20.

The double horseshoe shaped trough 24 is completed by a second upper vertically depending trough part 98 on part 40. Because of the relatively larger radius of the trough bend parts 94, 96, vertically extending trough part 98 is disposed outwardly of inner trough part 84. It also terminates short of this part in a vertical sense so that a discontinuity 100 is formed in double horseshoe shaped trough 24 to provide space or clearance for the mounting insertion of the inner end of suction hose 20 on tool and hose rack 10 and the mounting of the hose 20 generally in an overlapped manner.

Suction hose 20 at its upper stored end includes the suction end converter 36. This converter is received at its tip in a well 104 formed by a shaped slot dictated by the termination of a coplanar upper panel 106 on part 42 and a coplanar stepped rim piece 108 on part 40 having an inner transversely directed side walls and a back piece 110 displaced in a horizontal direction from upper panel 106 and stepped rim piece 108 and generally coplanar with web 68. A pair of projecting tips 112, 112 on ribs 64, 66 extending into the well 104 help maintained the converter 36 within this well.

At the lower end of the well 104 another tip 114 of rib 66 acts as a shelf for the vertical maintenance of converter 36 within the well 36 by engagement with a ledge 116 extending around the adjacent side and front of the converter 36. The remainder of the shape of the converter 36 is accommodated by the discontinuity 100 and a stepped strut 118 disposed below the rib 114 and integral with the flange 68 and enveloping one side of an enlargement 117 of converter 36.

After the suction hose 20 converter end 36 is inserted within the well 104 and nestled against the stepped strut 118, the remainder of the hose is wrapped downwardly around and then upwardly and then again downwardly around the double horseshoe shaped trough 24 utilizing the tabs, 26, 28, 26, 28, 26, 28, 26, 28 and 30, 32 to clampingly embrace the hose 20 and also hold it longitudinally or axially. The wand connecting end 38 of the hose 20 depends finally downwardly due to the fixing of the end of the hose 20 by tabs 30, 32. As was set out earlier, the hose may be slightly flexed during its insertion into horseshoe shaped trough 24 to aid in from retention of it on tool and hose rack 20.

Figure 11:
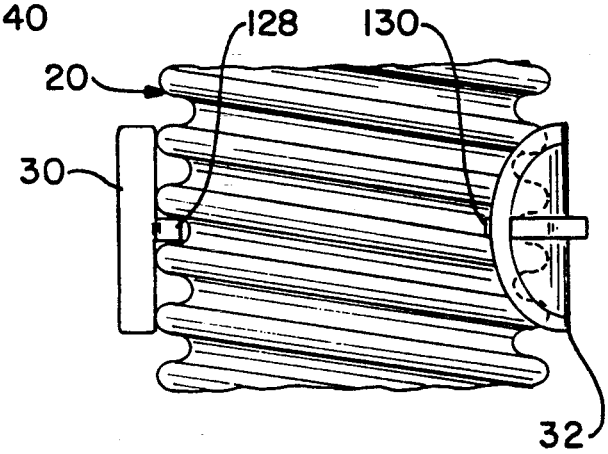
FIG. 11 is a fragmentary front view of a hose section, its engagement with the opposed tabs, and with tab ribs inserted into a hose corrugation.

The clamping action of the tabs is best seen by viewing FIGS. 9, 10 and 11. The tabs 26 are slightly bent but generally tangential to the curve of the horseshoe shaped trough and extend away from it in this slightly bent manner. The tabs 28 are more severely bent than the tabs 26 to curve inwardly as they extend from the horseshoe shaped trough 24 more steeply than the curvature of hose 20. By this arrangement the hose 20 is clamped on its circumference on the double horseshoe shaped trough 24 at four places around its periphery. At the same time, each of the straighter tabs 26 includes an internal rib 122, with this rib becoming annular as it extends, about one half the way around the inside periphery of the double horseshoe shaped trough 24. A confronting inner rib 124 on tab 28 extends around it bend configuration and then slight inwardly along the webs of the parts 40 and 42 of tool and hose rack 10. This rib has an entrance angle 125. The horseshoe shaped trough 24 is slotted by slots 126 (shown dashed) at the ribs 28 to aid in pulling the mold during molding of the tool and hose rack 10. This rib has an entrance angle 125.

The elongated tabs 30, 32 also include internal ribs 128, 130 also elongated to extend the length of the tabs, with the rib 128 also extending annularly for half the depth of the double horseshoe shaped trough 24. The tab 32 as well as its internal rib 130 are more severely bent than the tab 30 to compressingly clamp the hose 20 both circumferentially and longitudinally The hose 20 at this location (FIG. 1) is doubled or lapped but the length of the tabs 30 and 32 is sufficient to receive the doubled over hose 20. A molding slot is also present at the general location of rib 130.

The converter coupling 36 is generally rectangular in cross section and includes a pair of spaced, parallel side walls 132, 132 (only one shown) a bottom wall 134 and a top wall 136 which border an open mouth 138. Off the floor cleaner hose conversion is occasioned as is well known in the art by insertion of the converter coupling 36 into, e.g., an upright cleaner suction duct (not shown) so that the wall 136 blocks the agitator suction duct (not shown) while the mouth 138 is open to fan suction (not shown). The required structure of this coupling, however, makes the converter coupling 36 more fragile than the wand coupler 38 which is of generally tubular continuous cross section construction. It is, therefore, most desirable to mount the converter coupling sheltered inwardly of the spiral coil of hose 20 while leaving the wand.coupling outermost. This also encourages the operator of any cleaner with which this tool and hose rack is associated to fully uncoil the hose before it can be utilized. This is an advantage for a hose thusly mounted even with a more durable cleaner suction coupling.

The converter coupling includes an integral latch 140 for locking connection during cleaner conversion. Clearance for this latch when suction hose 20 is mounted in stored position is afforded by an aperture 142 in upper reaches of part 40.

The tools are stored on tool and hose rack 10 behind the double horseshoe shaped trough 24 on part 40 by an integral tool storage section 144. Conventionally, wells 146, 148 and 150 house, respectively, furniture nozzle 12, crevice tool 14 and wall and floor brush 16. Deformable rib pairs 152, 154 and 156 maintain, as is well known, the aforementioned tools in their respective wells for easy removal by the user. The rightward rib of each of the rib pairs 154 and 156 is formed by a vertically extending wall 157 integral with part 40.

The tool and hose rack 10 is completed by integral mounting means such as bent tabs 158 (lower), 160, 160 (medial) and screw mounting tab 162 which conveniently slot and screw mount the tool and hose rack to a cleaner handle or the like (not shown). It is to be understood (as set out previously) that the tool and hose rack 10 can be cleaner mounted by any other desired integral attaching tab arrangement or even be free standing.

It should be clear from the foregoing description that all the advantages of the invention have been satisfied by the invention described, and, further, that many modifications to the disclosed structure could be made which would still fall within its spirit and purview.

What is claimed is:

1. A rack for the mounting of a cleaner hose comprising;
   a) a serpentine shaped means for mounting said cleaner hose,
   b) said serpentine shaped mounting means being disposed for easily receiving said hose in a serpentine manner, and
   c) means for mounting said rack on an upright cleaner.

2. A rack for the mounting of a corrugated cleaner hose including;
   a) clip members which compressingly encompass at least a portion of the circumference of said hose, and
   b) rib members attached to an interior surface of said clip members, said rib members being insertable in at least some of said hose corrugations, thereby limiting axial movement of said hose on said rack.

3. The cleaner mounting rack of claim 2 wherein;
   a) said rack provides a serpentine mounting arrangement for said cleaner hose.

4. The cleaner hose mounting rack of claim 3 wherein;
   a) said rack is generally U-shaped in cross section to nest said hose within said U-shape in conforming relationship.

5. The cleaner hose rack of claim 4 wherein;
   a) said serpentine mounting arrangement of said rack is provided at least in part by opposite disposed horseshoe shaped bends, and
   b) one of said bends having a radius larger than the other of said bends.

6. The cleaner hose rack of claim 5 wherein;

a) said serpentine mounting arrangement includes a discontinuity between said bends, and b) said corrugated hose having an end mounted inwardly at said discontinuity.

7. The cleaner hose rack of claim 6 wherein;

a) said inward mounted end of said hose includes a coupling converter for off the floor cleaner operation.

8. The cleaner hose rack of claim 5 wherein;

a) said cleaner hose rack also includes provision for the storage of at least one cleaning tool.

9. A cleaner hose rack for the mounting of a cleaner hose including;

a) a serpentine mounting means for the storage of said cleaner hose;

b) said serpentine mounting means supporting said hose substantially continuously throughout its length, c) said cleaner hose including a converter coupling on one of its ends, d) said converter coupling being disposed inwardly on said serpentine mounting in its unconnected state whereby said converter coupling is protected and said hose must be completely demounted for cleaner converter coupling connection.

10. A cleaner hose rack for the mounting of a cleaner hose including;

a) a serpentine shaped mounting means for the mounting of said cleaner hose;

b) said serpentine shaped mounting means including an inner end that leads to a first horseshoe shaped bend, and c) an outer end leading from a second oppositely disposed horseshoe shaped bend.

11. The cleaner hose rack of claim 10 wherein;

a) said serpentine shaped mounting means includes a discontinuity between said inner and outer ends, and b) said cleaner hose includes an end extending into said discontinuity.

12. The cleaner hose rack of claim 10 wherein., a) said serpentine shaped mounting means is U-shaped in cross section, and b) said hose has at least a portion of its circumference nested in said U-shaped.

13. The cleaner hose rack of claim 10 wherein;

a) said serpentine shaped mounting means includes at least a rib extending transversely to said serpentine shape, and b) said rib engageable in a corrugation of said cleaner hose to maintain it axially.

* * * * *